United States Patent [19]

DeWerth et al.

[11] Patent Number: 4,629,415

[45] Date of Patent: Dec. 16, 1986

[54] FLAME INSERT

[75] Inventors: Douglas W. DeWerth; William G. Sterbik, both of Cleveland, Ohio

[73] Assignee: Gas Research Institute, Chicago, Ill.

[21] Appl. No.: 747,995

[22] Filed: Jun. 24, 1985

Related U.S. Application Data

[63] Continuation-in-part of Ser. No. 512,328, Jul. 11, 1983, Pat. No. 4,525,141.

[51] Int. Cl.[4] ..... F23D 14/12

[52] U.S. Cl. ..... 431/347; 126/39 E

[58] Field of Search ..... 431/347, 349, 350, 356; 126/39 E, 39 H, 39 J, 39 K, 92 R

[56] References Cited

U.S. PATENT DOCUMENTS

| | | | |
|---|---|---|---|
| 1,462,643 | 7/1923 | Kreutzer | 431/347 |
| 1,998,257 | 4/1935 | Smith | 431/356 |
| 2,174,962 | 10/1939 | Blayney | 431/347 |
| 2,280,061 | 4/1942 | Cartter et al. | 431/347 |
| 2,429,022 | 10/1947 | Groetchen | 431/347 |
| 2,720,258 | 10/1955 | Brodbeck et al. | 431/347 |
| 2,960,157 | 11/1960 | Dolby | 431/350 |
| 3,544,255 | 12/1970 | Roper | 431/347 |
| 3,649,211 | 3/1972 | Vosper | 431/347 X |
| 4,264,298 | 4/1981 | Simeoni | 431/347 |
| 4,284,402 | 8/1981 | Sheets et al. | 431/347 X |

FOREIGN PATENT DOCUMENTS

| | | | |
|---|---|---|---|
| 1522879 | 4/1968 | France | 431/347 |
| 123872 | 3/1919 | United Kingdom | 431/347 |

*Primary Examiner*—Margaret A. Focarino

*Attorney, Agent, or Firm*—Pearne, Gordon, Sessions, McCoy, Granger & Tilberry

[57] ABSTRACT

A flame insert for reducing the $NO_x$ emissions of a range top burner is disclosed. The flame insert comprises a rigid framework provided by disjuncted support members connected to a pair of ring members. The support members engage the burner head to mount and accurately position the ring members adjacent the burner ports for engaging the flames during combustion and reducing the peak flame temperature by radiating heat energy away from the flames.

25 Claims, 10 Drawing Figures

FLAME INSERT

BACKGROUND OF THE INVENTION AND PRIOR ART

This is a continuation-in-part application of co-pending application Ser. No. 512,328, filed July 11, 1983, now U.S. Pat. No. 4,525,141.

The present invention relates to the reduction of oxides of nitrogen (NO and $NO_2$) or $NO_x$ emissions in atmospheric type blue flame burners and, more particularly, to a flame insert for use with range top burners to regulate and reduce such emissions. The flame insert includes a flame engaging portion and a support portion which mounts the insert to the burner and accurately positions the flame engaging portion adjacent the burner ports. The flame engaging portion reduces the peak flame temperature and the $NO_x$ emissions.

It is not believed that flame inserts of the type of concern herein have been mounted to range top burners as contemplated in the present invention. However, it is known to mount various flame spreader devices to range top burners by the depending tabs which frictionally engage the burner head as shown in U.S. Pat. No. 1,998,257 or by welding as shown in U.S. Pat. No. 2,960,157. The mounting to a range burner of a spill over plate having an upper surface adapted to cooperate with a grate structure to support cooking utensils is shown in U.S. Pat. No. 2,148,777.

SUMMARY OF THE INVENTION

As indicated, a flame insert for a range top burner is provided in accordance with the present invention. The flame engaging portion of the insert includes surfaces which reduce the $NO_x$ emissions by radiating heat energy away from the flame to reduce the peak flame temperature. Preferably, the flame insert surfaces are positioned so that the flames extend along the profiles of the surfaces during combustion in accordance with the intended or designed operation of the burner. The insert surfaces engage the inner cones of the flames and dissipate heat energy without otherwise disturbing the desired combustion reaction. The flame insert is constructed to maintain the desired flame contact throughout the range of burner output settings. The insert surfaces have been found to induce the flames to extend there along despite variation in the operating position of the flame resulting from changes in the burner output setting or deviations from designed operation of the burner. Such flame inserts and their operation are described in detail in parent application Ser. No. 512,328, now U.S. Pat. No. 4,525,141 the teachings of the application being incorporated herein by reference.

The accuracy of the positioning of the flame insert on the burner head is assured by engagement of associated surfaces of the support portion and the burner which cooperate to fix the vertical and lateral position of the insert with respect to the burner head. The associated surfaces may comprise interfitting tapered or sloped surfaces, angularly offset surfaces or combinations thereof. In the illustrated embodiments, the support portion operates to engage a burner surface which is not perpendicular to the plane of the burner ports in order to laterally position the flame engaging portion at a predetermined spacing from the ports. The support portion similarly engages a burner surface which is not coplanar with the plane of the burner ports in order to vertically position the flange engaging portion at a predetermined spacing with respect to the ports. In preferred arrangements, each of the support members includes a pair of angularly offset surfaces for engaging associated angularly offset surfaces provided by the burners. Further, a plurality of associated surfaces are provided at spaced locations to assure the stability of the mounting of the insert to the burner and the precision of the positioning of the flame engaging portion with respect to the burner ports.

In a further aspect of the invention, the flame insert is removably mounted to the burner. This enables retrofitting existing burners with flame inserts and allows for user cleaning and replacement thereof. The flame insert is removably secured to the burner by frictional sliding engagement therewith to assure the proper positioning and operation of the flame engaging portion. In certain of the illustrated embodiments, the insert includes axially diverging surfaces which are arranged to engage the burner head and bias the insert to its proper position during mounting.

As shown in the illustrated embodiments, the flame insert may constitute a rigid framework wherein the support portion of the insert comprises a plurality of separate or disjuncted support members or arms and the flame engaging portion of the insert comprises a pair of elongate members fixed to the support arms. The support arms are spaced above the periphery of the burner head in mounting engagement therewith and extend to the burner ports to support the elongate members. The elongate members have a configuration corresponding with that of the array of the burner ports and extend along the periphery of the port arrangement in spaced relationship to each other and to the ports.

The support portion constitutes a minor portion of the overall mass of the flame insert and it is arranged to have a minimal effect upon the combustion process. Accordingly, the support portion may comprise about 25 to 35% of the total mass of the flame insert. Further, the support portion is mounted to the burner in an arrangement which reduces the extent of the support portion which is axially engaged by the flames during combustion. It is believed that the support portion comprises about 6 to 13% of the total mass of the flame insert which is engaged by the flames. In this manner, the effect of the insert upon the combustion process is substantially due to the flame engaging portion.

The flame insert may include grate-type utensil supporting portions or elements to provide supplementary utensil support. For example, if proper positioning of the flame insert interferes with a desired grate supporting function, the flame insert may be provided with alternative great-type utensil supporting elements as required by the grate modification to accommodate the insert member. Such an interference is more often encountered in retrofitting flame inserts to existing burners.

The flame insert may also be used to support or mount a baffle for regulating secondary air flow to the burner. The use of such a baffle to impede the ingress of secondary air into the flame zone has been found effective to lower $NO_x$ emissions. This further reduction in $NO_x$ emissions is believed to result from restricting the availability in the flame zone of reactants required for $NO_x$ formation.

The flame insert or component parts thereof may be of a metallic material or a nonmetallic material, or a combination of such materials. For example, corrosionresistant metals such as stainless steel have been found satisfactory as have ceramic materials including alumina, mullite, and cordierite.

The elongate members may have a variety of cross-sectional shapes. These include arcuate shapes such as circular or oval as well as polygonal shapes such as triangular and retangular.

DETAILED DESCRIPTION OF THE DRAWINGS

Figure 1:
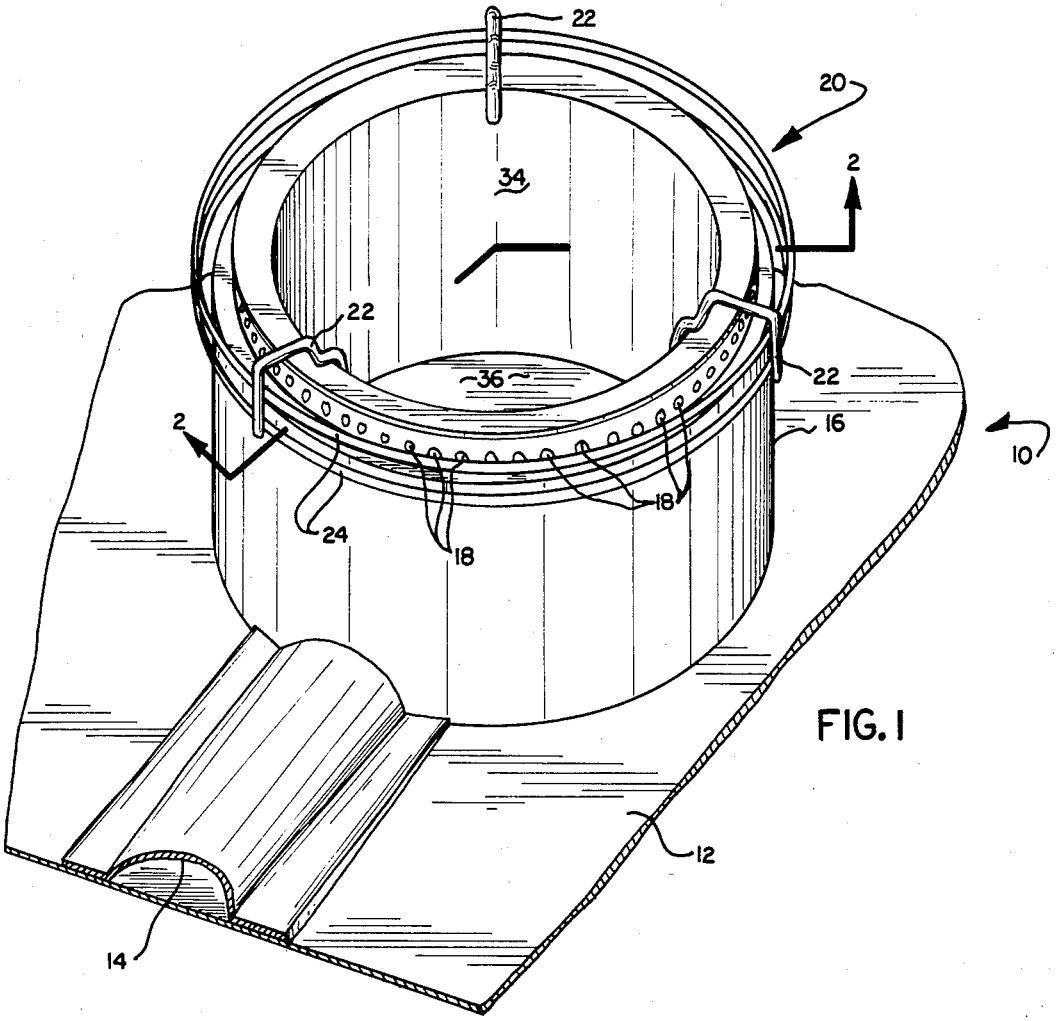
FIG. 1 is a perspective view of a range top burner having a flame insert mounted thereto in accordance with the present invention with parts broken away and omitted.
Figure 2:
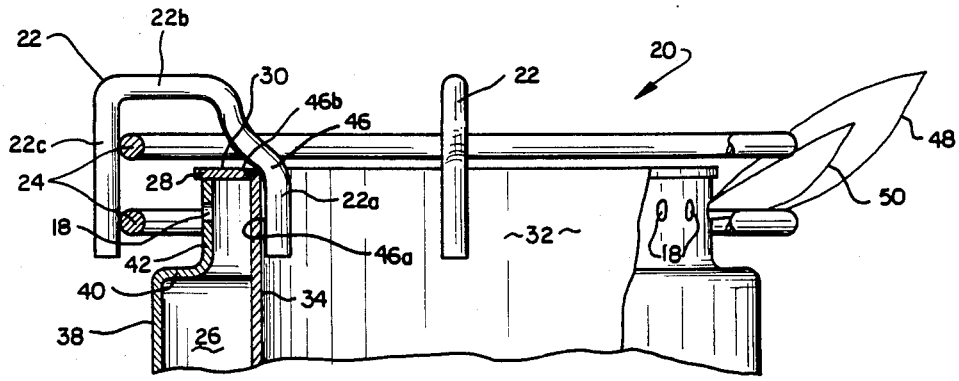
FIG. 2 is an elevational view, partially in section, of the burner head and flame insert as shown in FIG. 1 with parts broken away and omitted.

Referring to FIGS. 1 and 2, there is shown a range top burner 10 including a lower burner tray 12, a mixing tube 14, and a burner head or cap 16 which includes an array of burner ports 18. In accordance with conventional techniques, fuel gas such as natural gas is mixed with combustion air in the tube 14 and delivered to the burner head 16 which includes interior passageways for delivery of the mixture to the ports 18 for purposes of combustion. In a typical range, four such burners are usually provided.

A flame insert 20 is mounted to the burner head for purposes of reducing the $NO_x$ emissions of the burner during combustion. The flame insert 20 comprises a rigid framework provided by a plurality of disjuncted support members or arms 22 connected to spaced elongate members or ring elements 24. As described in greater detail below, the flame insert 20 is of sufficient structural rigidity and has sufficient thermal resistance to avoid significant distortion during prolonged use at high temperatures in order to assure the maintenance of the proper positioning of the insert.

As indicated above, the burner head 16 includes a passageway 26 (FIG. 2) for receiving the mixture of gas and air from the tube 14 and distributing it to the burner ports 18 located about the periphery of the burner head. The burner head 16 is an integral aluminum construction including a top wall or ledge 28 having an upper burner surface 30 with a central recess 32 therein. The recess 32 includes a downwardly extending recess sidewall 34 of cylindrical configuration and a recess bottom wall 36. The burner head also includes an outer wall 38 having a radially inward extending shoulder 40 to provide a wall portion 42 of reduced diameter. As best shown in the left hand side of FIG. 2, the passageway 26 is of reduced dimension adjacent the ports 18 which extend through the wall portion 42.

As described, the burner head 16 has a generally cylindrical configuration, the longitudinal axis thereof extending in a vertical direction. The passageway 26 is defined by the recess sidewall 34 and outer wall 38 and the passageway also has a cylindrical configuration. The burner head 16 may be provided as a removable cap element corresponding with the upper portion of the burner head 16 beginning at a location just below the shoulder 40.

The flame insert 20 is now described in greater detail. The support arm 22 includes a burner head engaging portion **22*a* which extends into the central recess 32. The burner engaging portion 22*a* is connected to an intermediate portion 22*b* which extends radially or laterally outward to a vertically oriented ring engaging portion 22*c* located adjacent burner ports 18. Accordingly, the support arm 22 is provided with an inverted U-shaped rod configuration with portions 22*a* and 22*c* corresponding with the legs of the U and portion 22*b*** providing the bight.

The burner engaging portion **22*a* of the support arm 22 includes a shoulder 46 which engages the rim of the recess 32 comprising the annular edge surface defined by the intersection of the surface of the sidewall 34 of the recess 32 and the upper surface 30 of the ledge 28. The tapered or sloped configuration of the shoulder 46 operates in the manner of a cam and tends to automatically center and position the insert 20 as it is mounted to the burner head 16. As shown in FIG. 2, the movement of the insert 20 from its proper position is restricted by the vertically extending surface of the sidewall 34 which is engaged by a shoulder surface 46*a* provided by the support arm portion 22*a* below the shoulder 46 and the upper surface 30 of the ledge 28 which is engaged by a shoulder surface 46*b* provided by the portion 22*a* above the shoulder 46**.

The burner head engaging portions **22*a* received within the recess 32 are arranged in a circular pattern sized to locate the surfaces 46*a* along the circumference of a circle having a diameter slightly less than that of the recess 32. The clearance or spacing between the associated engaging surfaces 46*a* and 34 is selected to assure proper operation of the flame insert 20 even if it is moved to an extreme position. In this manner, the horizontal and vertical position of the ring elements 24 is accurately and precisely fixed with respect to the burner ports 18**.

The flame insert 20 may be mounted to the burner head using only two support arms positioned along a diameter passing through the recess 32. However, it is preferred to use three equally angularly spaced support arms 22 as shown.

The support arms 22 and, more particularly, the burner head engaging portions **22*a* thereof are sized to provide a frictional close fit with the burner head 16 sufficient to assure the accuracy of the positioning of the ring elements 24 and the proper operation thereof without otherwise presenting problems in the installation and removal of the flame insert by hand manipulation without the use of tools. Thus, the flame insert 20 is manufactered with part tolerances which assure that the support arm surfaces 46***a* and 46*b* will index against the associated offset burner head surfaces 34 and 30 to properly position the flame insert.

The proper positioning of the ring elements 24 is illustrated in the right hand side of FIG. 2 where a flamelet 48 is diagramatically shown. The flamelet 48 includes an inner cone 50 which extends along the profile of the surfaces of the ring elements 24 during combustion in accordance with the intended or designed operation of the burner without such ring elements being present. The ring elements 24 are designed and positioned to maintain such engagement throughout the full range of operation of the burner and reduce the peak flame temperature by radiating heat away from the flames. The reduction of the peak flame temperature has been found to reduce the $NO_x$ emissions.

As noted above, the flame insert 20 is of sufficient structural rigidity and thermal resistance to maintain its configuration despite prolonged exposure to range operating temperatures and user handling such as for purposes of cleaning. The use of 304 stainless steel wire of 11 gauge size to fabricate the flame insert 20 has been found to provide the foregoing characteristics. In such a construction, each of the ring elements 24 is deformed to a circular configuration of the desired diameter, three inches for example, and its adjacent ends are welded. Similarly, the ring elements are welded to the support arms 22 in order to complete the structure.

The foregoing construction is efficient from a standpoint of material usage since a single rigid framework is provided to achieve both the mounting and flame engaging functions. Also, it is apparent that the contact between the support arms and flames is minimized so that the flame engagement is substantially provided by the ring elements only.

Figure 3:
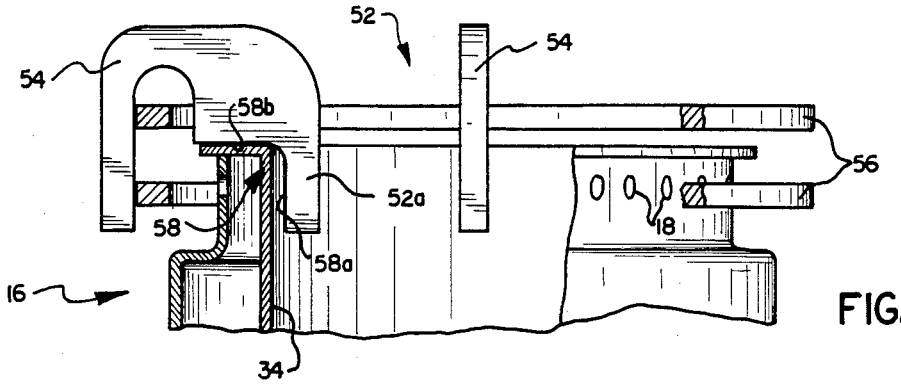
FIG. 3 is an elevational view similar to FIG. 2 showing another embodiment of the flame insert.

Referring to FIG. 3, a modified flame insert 52 is shown mounted to the burner head 16. The flame insert 52 includes separate support arms 54 which connect ring elements 56. The flame insert 52 is also positioned by indexing of the support arms 54 against angularly offset surfaces. Each support arm 54 is provided with a burner head engaging portion 52 including a notch 58. The notch 58 provides offset surfaces 58*a* and 58*b* which respectively engage the recess sidewall 34 and the upper burner surface 30 for purposes of positioning the ring elements 56 with respect to the ports 18. The offset surfaces 58*a* and 58*b* are connected by an arcuate surface portion which engages the rim of the recess 32 and operates to bias the flame insert 20 into position as it is placed on the burner head 16.

The support arms 54 are formed of a flat metallic stock material such as 304 stainless steel of 12 gauge thickness, and the arm dimensions are increased as compared with the support arms 22. This provides increased structural and thermal stability. The increased dimensions of the support arms 54 do not result in corresponding increases in flame contact or disruption since the major dimensions extend in a vertical direction and are aligned with the flame directions.

The ring elements 56 are provided with a rectangular cross section and they may be formed of the same stock material as the support arms 54. Accordingly, each of the ring elements 56 has a cross sectional size of 0.093" by 0.120". The ring elements 56 may be deformed and welded to provide the desired circular configuration. Similarly, the ring elements 56 may be welded to the support arms 54.

Figure 4:
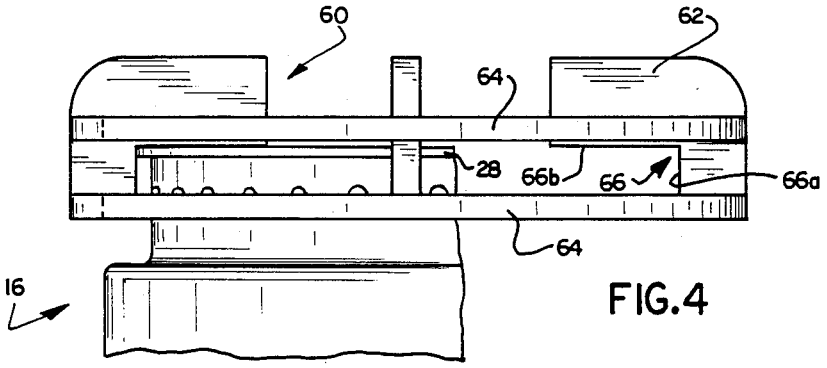
FIG. 4 is an elevational view similar to FIG. 3 showing a further embodiment of the flame insert.

Referring to FIG. 4, a flame insert 60 is shown mounted to the burner head 16. The insert 60 includes three support arms 62 and two ring elements 64. (For convenience of illustration, the support arm 62 is also shown in elevation in the right side of FIG. 4.) The support arm 62 is provided with a notch 66 which in turn provides offset surfaces 66*a* and 66*b*. In this instance, the offset surface 66*a* engages an outer sidewall surface of the ledge 28 in order to determine the radial or lateral positioning of the insert 60. The arms 62 are arranged in a circular pattern sized to locate the surfaces 66*a* along the circumference of a circle having a diameter slightly larger than the outside diameter of ledge 28. The offset surface 66*b* engages the upper burner surface 30 in order to fix the vertical positioning of the insert 60.

Figure 5:
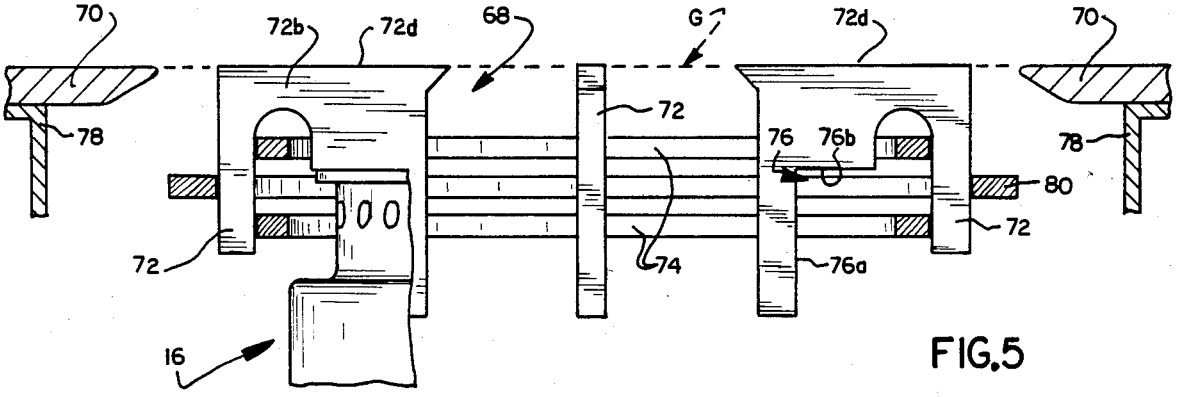
FIG. 5 is an elevational view similar to FIG. 4 showing another embodiment of the flame insert which includes grate elements for supporting cooking utensils.

Referring to FIG. 5, a flame insert 68 is shown mounted to the burner head 16. The flame insert 68 is constructed to provide support for cooking utensils to be heated on the burner and, more particularly, to provide cooperative support with the existing grate elements. For convenience, portions of great elements 70 are shown in FIG. 5.

In some applications, the need for the flame insert to provide a utensil support function may result from the modification of an existing grate structure which would otherwise interfere with the flame insert. Thus, the grate structure may be modified by removing portions of grate element adjacent to the burner and replacing the support function by means of the flame insert.

The flame insert 68 includes support arms 72 and ring elements 74. Each support arm 72 includes a notch 76 which provides offset surfaces 76*a* and 76*b* for respectively engaging the recess sidewall 34 and upper burner surface 30. Accordingly, the flame insert 68 operates to position the ring elements 74 in the same manner as used in the embodiments of FIGS. 1–3.

The grate elements 70 are supported by adjacent range top portions 78 at a grate height, indicated by the line G, spaced a predetermined distance above the burner head 16. Accordingly, each of the support arms 72 includes an enlarged laterally extending intermediate portion 72*b* which projects from the burner head to the grate height to provide utensil supporting surface 72*d*.

The flame insert 68 also includes a baffle member or ring 80 connected to support arm 72 intermediate the ring elements 74. The baffle ring 80 restricts the secondary air flow to the flame zone so as to further reduce the $NO_x$ emission level. The baffle ring 80 may be formed of the same materials as the ring elements 74 and it may be connected to the support arm at any location where it effectively impedes the ingress of secondary air into the flame zone of the burner head 16.

Figure 6:
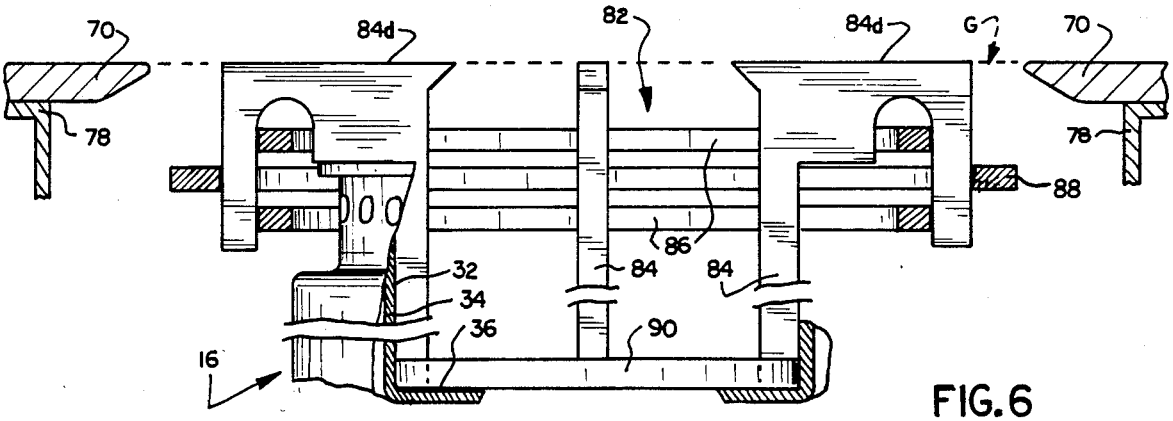
FIG. 6 is an elevational view similar to FIG. 5 of a further embodiment of a flame insert including grate elements.

Referring to FIG. 6, a flame insert 82 is shown mounted to a burner head 16. The flame insert 82 includes support arms 84 connecting spaced ring elements 86. A baffle member or ring 88 is also connected to the support arms 84.

The support arms 84 extend to the bottom of the central recess 32 where they are connected to an annular support ring 90 positioned on the recess bottom wall 36. As indicated in FIG. 6, the outside diameter of the support ring 90 is slightly less than the inside diameter of the annular recess. Accordingly, the flame insert 82 is indexed to its proper lateral or radial position by engagement of the support arms 84 and/or the support ring 90 with the recess sidewall and to its proper axial position by engagement of the support ring 90 with the recess bottom wall 36.

The flame insert 82 is adapted to cooperate in the support of cooking utensils. Thus, each of the support arms 84 includes a utensil supporting surface 84*d* which is positioned at the grate height.

Figure 7:
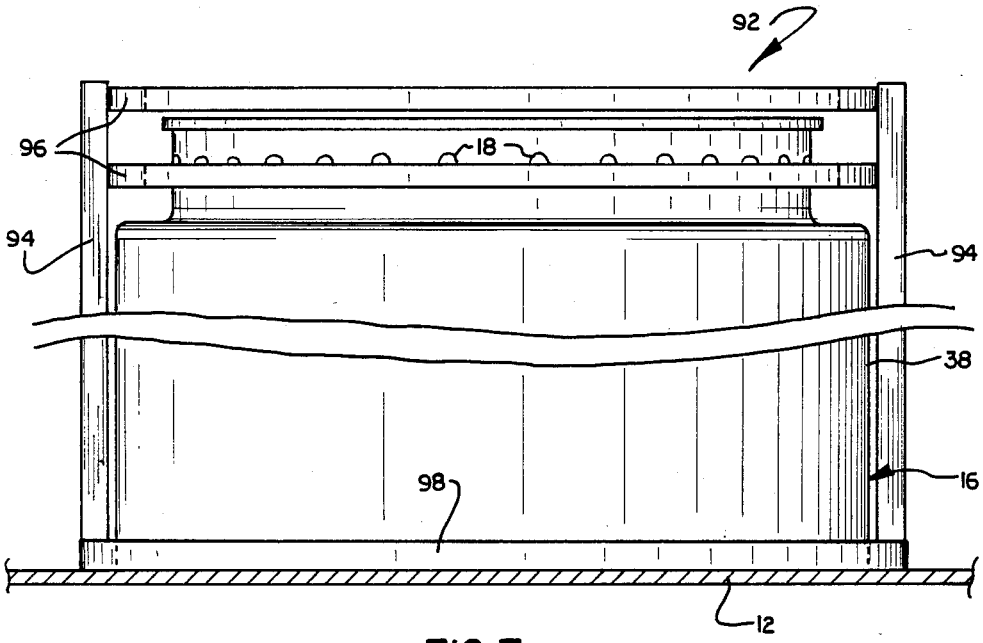
FIG. 7 is an elevational view similar to FIG. 6 of another embodiment of the flame insert arranged to mount to the burner tray.

Referring to FIG. 7, a flame insert 92 is shown mounted to the burner head 16. In this embodiment, the flame insert 92 includes support arms 94 which connect and mount ring elements 96 adjacent to the ports 18 of the burner head.

The support arms 94 are laterally spaced from the outer wall 38 of the burner head 16. Each of the support arms 94 is connected at its lower end to an annular support ring 98 positioned on the burner tray 12. The inside diameter of the support ring 98 is slightly larger than the outside diameter of the outer wall 38 of the burner head 16. Thus, the flame insert 92 is indexed to its proper position by engagement of the support ring 98 along its inside diameter surface with the outer wall 38 and along its lower surface with the burner tray 12.

Figure 8A:
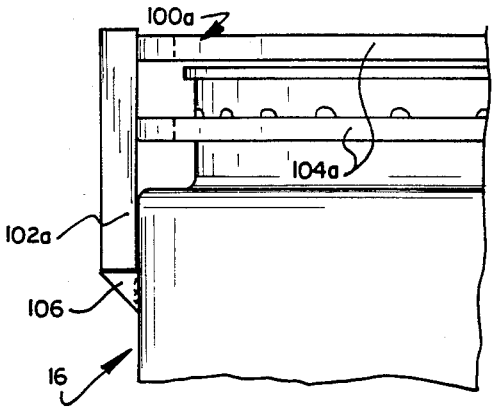
FIG. 8A is an elevational view similar to FIG. 7 showing an embodiment of the flame insert arranged for mounting to the side of the burner head.
Figure 8B:
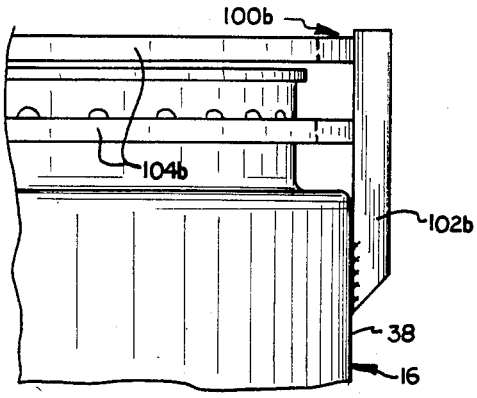
FIG. 8B is an elevational view similar to FIG. 8A, showing another embodiment of the flame insert arranged for mounting to the side of the burner head.

Referring to FIG. 8, a flame insert 100*a* is shown mounted to the burner head 16 in the left hand side of the figure. The flame insert 100*a* includes support arms 102*a* which connect ring elements 104*a*. In this embodiment, mounting ledges 106 are secured to the outer wall 38 of the burner head 16 for supporting the arms 102*a*. The mounting ledges may extend around part or all of the circumference of the outer wall 38 and may be secured thereto by fusing or in some other suitable manner. The flame insert 100*a* is removable and it is indexed to its proper position by engagement of the support arms 102*a* with the outer wall 38 and mounting ledges 106 of the burner head.

Flame insert 100*b* shown on the right hand side of FIG. 8 is similar to insert 100*a* except that support arms 102*b* are fixed to the burner head 16 or integrally formed therewith. For example, the support arms 102*b* may be fused to the outer wall 38 of the burner along the adjacent portions thereof or secured to the outer wall by a mechanical fastener such as a threaded fastener. Alternatively, the support arms 102*b* may be integrally formed as an extension of the outer wall 38. The flame insert 100*b* is not removable from the burner head without physically damaging the flame insert or the burner head.

Figure 9:
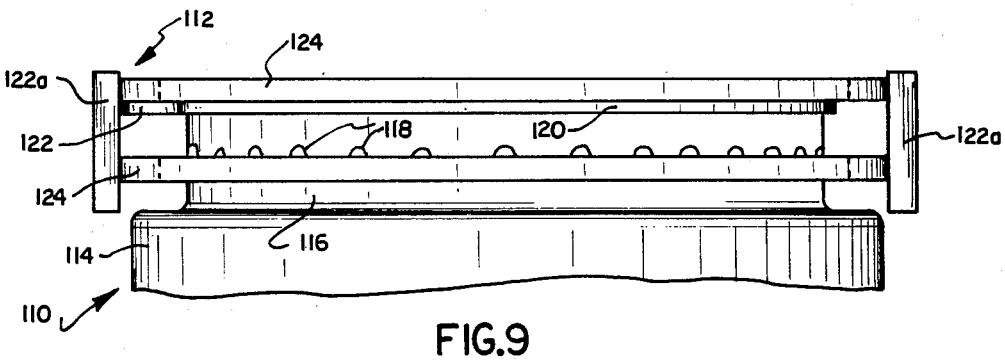
FIG. 9 is an elevational view similar to FIG. 8B showing another embodiment of the flame insert modified for mounting to the upper regions of the burner head.

Referring to FIG. 9, a burner head 110 having an integral flame insert 112 is shown. The burner head 110 includes a lower annular portion 114 connected to an upper annular portion 116 of reduced diameter having an array of burner ports 118 therein. The top of the burner head 110 is closed by a ledge 120.

The ledge 120 includes a plurality of angularly spaced integrally formed support arms 112, only one of which is shown in FIG. 9. The support arms 122 comprise radially extending portions of the ledge 120 located at equally angularly spaced locations about the periphery of the ledge. Although any number of support arms 122 may be provided, it is convenient to provide three such arms in order to assure the stability of the flame insert 112. The support arms 122 include vertically extending portions 122*a* which connect ring elements 124.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is consistent with the extent to which the progress in the art has been advanced by the invention.

What is claimed is:

1. A flame insert for reducing the $NO_x$ emissions of a burner including a burner head having an array of burner ports from which flames extend during combustion, said flame insert comprising a rigid framework provided by a plurality of disjuncted support members connected to a plurality of elongate members, each of said elongate members comprising a ring member and each of said support members comprising a ring engaging portion securing the ring members together and a burner head engaging portion for mounting said insert to the burner head and positioning said ring members adjacent said burner ports in a predetermined flame engaging position, said ring members being operable in said predetermined position to engage flames extending from the burner ports during combustion and to reduce the peak flame temperature by radiating heat energy away from the flames.

2. A flame insert as set forth in claim 1, wherein each of said support members includes associated insert surfaces which are angularly offset and are adapted to engage associated burner surfaces when said flame insert is mounted to said burner head to position said ring members with respect to said burner ports.

3. A flame insert as set forth in claim 2, wherein said associated surfaces are arranged and sized to removably engage said burner head in a frictional close fit.

4. A flame insert as set forth in claim 3, wherein one of said associated insert surfaces is horizontally oriented and the other of said associated insert surfaces is vertically oriented when said flame insert is mounted to said burner head.

5. A flame insert as set forth in claim 1, wherein said ring members are connected together solely by said support members, said support members are arranged and sized to engage said burner head in a frictional close fit to removably mount said flame insert to said burner head, and each of said support members comprises an inverted U-shaped rod member having first and second legs connected by a laterally extending intermediate portion, said first leg providing said ring engaging portion and said second leg providing said burner head engaging portion.

6. A flame insert as set forth in claim 1, wherein said burner head includes an upper burner head surface having a central recess and said support members extend into said recess for engaging said burner head.

7. A flame insert as set forth in claim 6, wherein said central recess includes a downwardly extending recess sidewall and a laterally extending recess bottom wall, and said support members are adapted to engage said upper burner head surface and said downwardly extending recess wall to position said ring members.

8. A flame insert as set forth in claim 6, wherein said central recess includes a downwardly extending recess sidewall and a laterally extending recess bottom wall, and said suport members are adapted to engage said upper burner head surface and said recess bottom wall to position said ring members.

9. A flame insert as set forth in claim 1, wherein said burner head includes an upper burner head surface and an outer sidewall surface, and said support members are adapted to engage said upper and outer sidewall surfaces of the burner head to position said ring members.

10. A flame insert as set forth in claim 9, wherein said flame insert is integrally formed with said burner head.

11. A flame insert as set forth in claim 9, wherein said burner includes a burner tray having an upper tray surface from which said burner head projects, and said support members are adapted to engage said outer sidewall surface of said burner head and said upper tray surface of the burner tray to position said ring members.

12. A flame insert as set forth in claim 1, wherein said support members include means adapted to fix said flame insert to said burner head to prevent user removal of the flame insert without physically damaging the burner head or flame insert.

13. A flame insert as set forth in claim 1, wherein a baffle member is connected to said support members and said baffle member is adapted to extend laterally along said array of burner ports for regulating the flow of secondary air to said flames during combustion.

14. A flame insert as set forth in claim 13, wherein said baffle member is mounted between said ring members.

15. A flame insert as set forth in claim 1, wherein said support members include laterally extending surface portions adapted to support cooking utensils to be heated on said burner.

16. A flame insert as set forth in claim 1, wherein said range top burner includes grate elements for supporting cooking utensils at a grate height spaced a predetermined distance above said burner head, and said support members include utensil supporting portions extending from said burner head to said grate height to cooperate with said grate elements to support cooking utensils.

17. A flame insert as set forth in claim 1, wherein each of said support members comprises a U-shaped rod member having first and second legs which respectively provide said ring engaging and burner head engaging portions.

18. A flame insert as set forth in claim 17, wherein said second leg of each of said U-shaped rod members includes a pair of angularly offset surfaces for engaging associated offset surfaces of the burner head in a frictional close fit to removably mount said flame insert to said burner head.

19. A flame insert as set forth in claim 18, wherein said ring members and U-shaped rod members are provided by metallic wire material having a circular cross-section.

20. A flame insert for reducing the $NO_x$ emissions of a range top burner including a generally cylindrical burner head having a longitudinal axis and a substantially symmetrical radial configuration with burner ports located about the periphery thereof, said flame insert comprising a rigid framework provided by a plurality of disjuncted support members connected to a plurality of ring members, said support members including angularly offset insert surfaces adapted to engage associated angularly offset burner surfaces in a sliding frictional close fit to mount and position said ring members adjacent said burner ports in a predetermined flame engaging position, said ring members being operable in said predetermined position to engage flames extending from the burner ports during combustion and to reduce the peak flame temperature by radiating heat energy away from the flames.

21. A flame insert as set forth in claim 20, wherein one of said associatd insert surfaces is horizontally oriented and the other of said associated insert surfaces is vertically oriented when said flame insert is mounted to said burner head.

22. A flame insert as set forth in claim 21, wherein said burner head includes an upper burner head surface having a central recess and said support members are adapted to extend into said recess for engaging said burner head.

23. A flame insert as set forth in claim 22, wherein said central recess includes a downwardly extending recess sidewall and a laterally extending recess bottom wall, and said support members are adapted to engage said upper burner head surface and said downwardly extending recess wall to position said elongate members.

24. A flame insert as set forth in claim 21, wherein each of said support members includes a sloping surface operable to engage said burner head and bias said flame insert to said predetermined position as said flame insert is mounted to said burner head.

25. A flame insert as set forth in claim 24, wherein said sloping surface extends between said angularly offset surfaces.

* * * * *